United States Patent [19]

Sumi

[11] Patent Number: 4,911,120

[45] Date of Patent: Mar. 27, 1990

[54] LUBRICATION SYSTEM FOR ENGINES

[75] Inventor: Kiyohide Sumi, Tokyo, Japan

[73] Assignee: Fuji Jokogyo Kabushiki Kaisha, Tokyo, Japan

[21] Appl. No.: 281,324

[22] Filed: Dec. 8, 1988

[30] Foreign Application Priority Data

Dec. 28, 1987 [JP] Japan ..... 62-200316[U]

[51] Int. Cl.[4] ..... F01M 1/00

[52] U.S. Cl. ..... 123/196 R; 123/90.38

[58] Field of Search ..... 123/196 R, 196 W, 196 M, 123/90.33, 90.38; 184/13.1, 11.1

[56] References Cited

U.S. PATENT DOCUMENTS

| | | | |
|---|---|---|---|
| 4,404,936 | 9/1983 | Tatebe et al. | 123/90.38 |
| 4,601,267 | 7/1986 | Kronich | 123/90.33 |
| 4,630,580 | 12/1986 | Sawaki et al. | 123/196 R |
| 4,662,322 | 5/1987 | Tumba et al. | 123/196 W |

*Primary Examiner*—E. Rollins Cross

*Attorney, Agent, or Firm*—Beveridge, De Grandi & Weilacher

[57] ABSTRACT

A lubrication system for engines, comprising a main engine body with a crank chamber formed at the bottom portion thereof for storing lubricating oil therein, a rocker cover securely attached to the outside wall of the engine body so as to surround a rocker arm, thereby forming therein a rocker chamber, lubricating oil supply means for supplying the lubricating oil into the rocker chamber, lubricating oil return means for returning the lubricating oil in the rocker chamber to the crank chamber, a breather device intercommunicating between the crank chamber and a suction system, and bypass means for intercommunicating through the breather device between the crank chamber and the rocker chamber. The bypass means causes the gas under pressure in the crank chamber to flow into the rocker chamber and the lubricating oil supplied into the rocker chamber, is forcibly discharged into the crank chamber through the lubricating oil return means.

7 Claims, 3 Drawing Sheets

LUBRICATION SYSTEM FOR ENGINES

BACKGROUND OF THE INVENTION

The present invention relates to a lubrication system for engines and more particularly, to a lubrication system capable of carrying out efficient and satisfactory lubrication of the rocker chambers of engines with forced-lubrication systems.

In conventional overhead valve (OHV) engines with splash lubrication systems, for instance as disclosed in Japanese Laid-Open Utility Model Application No. 58-156113, the lubricating oil mist and the blow-by gas in the crank chamber formed in a main engine body casing, are fed into the rocker chambers so that the rocker chambers are lubricated and the blow-by gas separated from the mist of the lubricating oil is supplied to an air cleaner or other system to be burned again.

In general, in the case of forced lubrication system engines such as OHV engines, overhead cam (OHC) engines and the like, the lubricating oil supplied to the rocker chambers returns by its own weight to the crank chamber through oil return passages. In the above mentioned lubrication system, there arises the problem that the rocker chambers are easily filled with the lubricating oil due to blow-back, etc. of the lubricating oil from the oil return passages.

Meanwhile in the case of engines of the type described above, various technical means are employed in order to prevent icing and to accelerate the vaporization of the fuel. For instance, Japanese Laid-Open Utility Model Application No. 56-17713 discloses a technique in which a cooling passage is extended parallel to a suction passage so that the cooling oil flowing through the cooling passage heats the suction passage, thereby accelerating the vaporization of the fuel. Furthermore, Japanese Laid-Open Utility Model Application No. 56-20544 discloses a technique in which an exhaust passage is extended parallel to a suction passage so that the suction passage is heated by the heat of the exhaust gas flowing through the exhaust passage.

However, as the cooling water or exhaust gas must be returned to a cooling water passage or an exhaust pipe, the engine construction becomes complicated. Furthermore a system for heating the suction passage by cooling water cannot be employed in air-cooled engines.

SUMMARY OF THE INVENTION

In view of the above, the primary object of the present invention is to provide a lubrication system in which the lubricating oil supplied into the rocker chamber is forcibly discharged so that the efficient circulation of the lubricating oil can be ensured.

To the above and other ends, the present invention provides a lubrication system for engines comprising a main engine body in which a crank chamber for storing the lubricating oil is defined at the bottom portion of the engine body, a rocker cover securely attached to the outer wall of the engine body so as to surround a rocker arm, thereby defining therein a rocker chamber, lubricating oil supply means for supplying the lubricating oil into the rocker chamber, lubricating oil return means for returning the lubricating oil in the rocker chamber to the crank chamber, a breather device for intercommunicating between the crank chamber and a suction system, and a bypass means for intercommunicating through the breather device between the crank chamber and the rocker chamber.

According to the present invention, the gas under pressure in the crank chamber is supplied to the rocker chamber by the bypass means and the lubricating oil supplied into the rocker chamber is forcibly discharged through the lubricating oil return means into the crank chamber so that the efficient circulation of the lubricating oil in the engine can be ensured.

DESCRIPTION OF THE PREFERRED EMBODIMENTS

Some preferred embodiments of the present invention will now be described in detail hereinafter with reference to the accompanying drawings.

Figure 1:
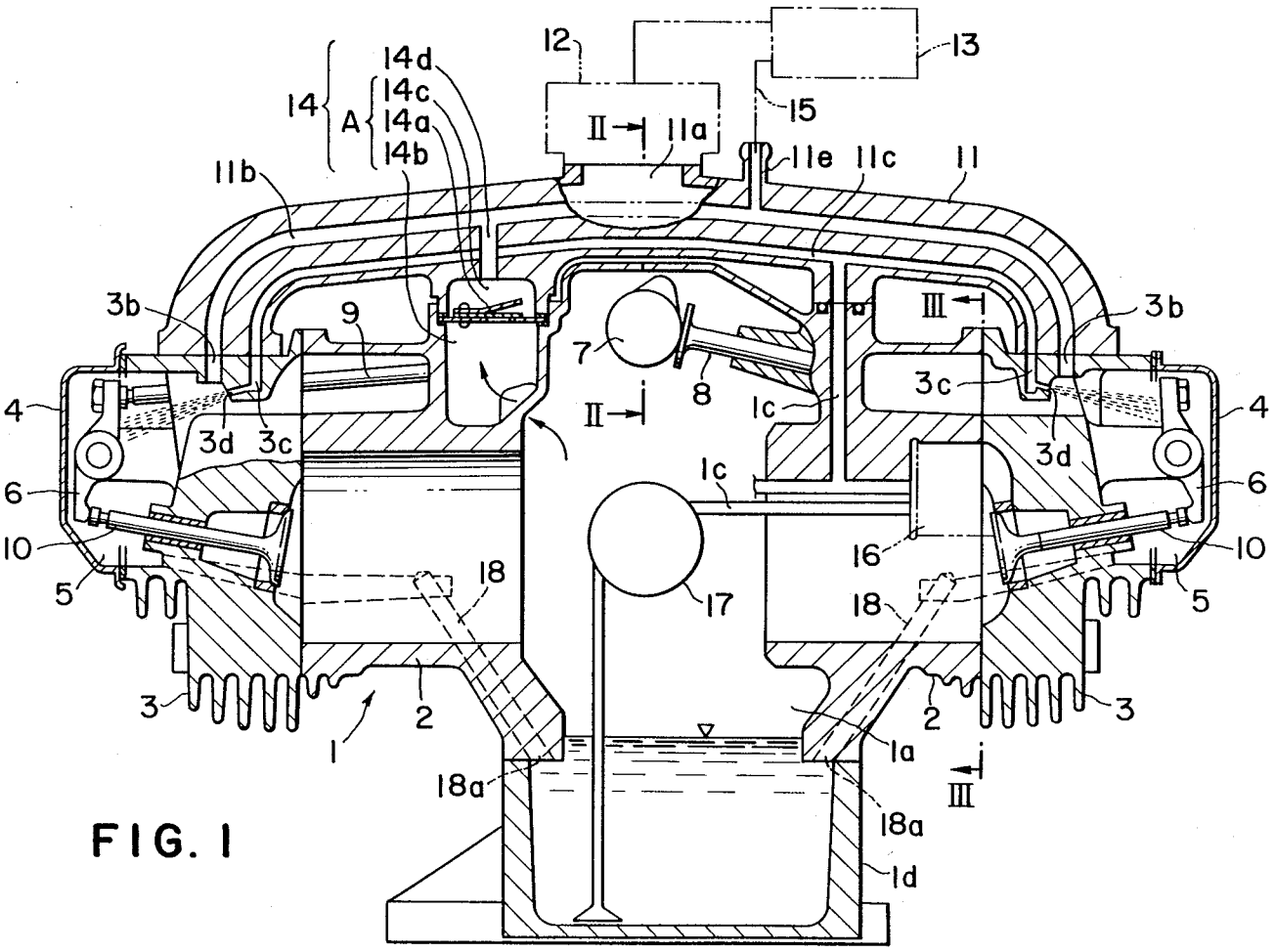
FIG. 1 is a longitudinal sectional view of a preferred embodiment of the present invention applied to a horizontal opposed-piston type engine.

Referring first to FIG. 1, a cylinder head 3 is securely mounted on the top surface of a cylinder block 2 integrally formed with the banks on both sides (RH, LH) of a main engine body 1 and the top surface of the cylinder head 3 is surrounded by a rocker cover 4 to define a rocker chamber 5.

In the rocker chamber 5 thus defined is disposed a rocker arm 6 whose rear end is connected through a push rod 9 to a tappet 8 made in sliding contact with a cam shaft 7 disposed in a crank chamber 1*a* of the engine body 1 and whose front end is connected to the stem end of a suction (or exhaust) valve 10.

A suction pipe 11 which is mounted on the upper portion of the engine body 1 has both of its ends securely fixed to the cylinder head 3 and a carburetor 12 is communicated with the suction pipe 11 substantially at the midpoint of its ends. An air cleaner 13 is disposed above and is communicated with the carburetor 12.

Within the suction pipe 11 are extended a suction passage 11*a*, a pressure passage 11*b* through which the gas flows under pressure, and a lubricating oil passage 11*c*. The side surfaces of the suction pipe 11 are formed with cooling fins 11*d*. The air passage which intercommunicates between the air chamber of the carburetor 12 and a suction port (not shown) of each cylinder is formed in the cylinder head 3.

The pressure passage 11*b* is extended along one side in the bottom portion of the suction passage 11*a* and is communicated through a breathing passage 14*d* with a breathing chamber A. Furthermore, a nipple 11*e* is extended from a suitable position of the pressure passage 11*b* to connect the air cleaner 13 through a breathing pipe 15.

The breathing chamber A is formed at the portion at which the suction pipe 11 is made into contact with the engine body 1 and is divided into a first breathing chamber 14*d* and a second breathing chamber 14*c* by a breather valve 14*a*. The first breather chamber 11*b* is communicated with the crank chamber 1*a*. The outlet of the pressure passage 11b extended through the suction pipe 11 is communicated with one end of a pressure passage 3b which is extended through the cylinder head 3 and is communicated with the rocker chamber 5. Both of the outlets of the lubricating oil passage 11c are communicated with lubricating oil passages 3c, respectively, extended through the cylinder head 3 and communicated with nozzles 3d opened into the rocker chambers 5, respectively.

The lubricating oil passage 11c is communicated with a lubricating oil passage 1c extended through the engine body, and an oil element 16 is inserted at a suitable position along the lubricating oil passage 1c. An oil pump 17 which is connected to a crankshaft (not shown) is disposed upstream of the oil element 16. The inlet port of the lubricating oil passage 1c is opened in the vicinity of the bottom of an oil pan 1d formed at the bottom portion of the engine body 1.

An oil return passage 18 which is opened at the bottom of the rocker chamber 5 is extended through the cylinder head 3. The outlet port 18a of the coil return passage 18 is opened into the lubricating oil stored in the oil pan 1d.

Figure 2:
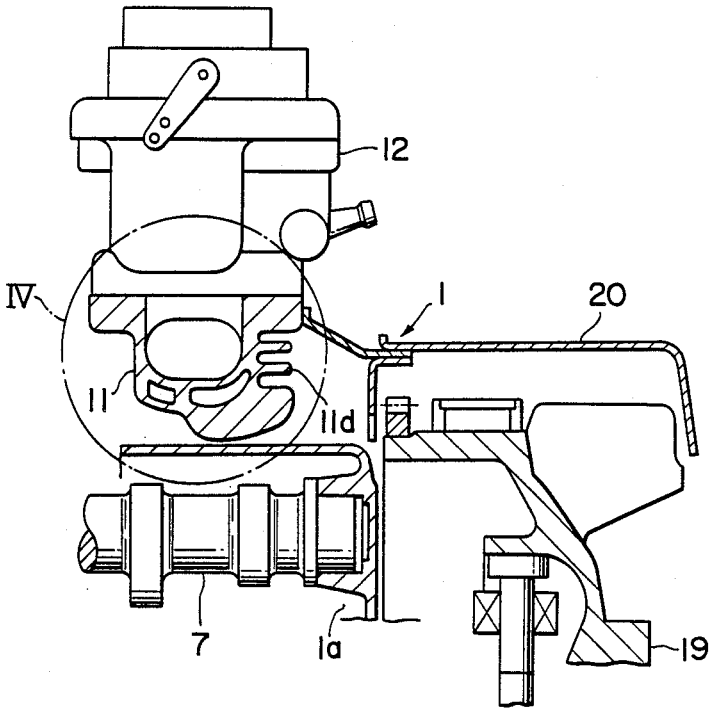
FIG. 2 is a sectional view taken along the line II—II of FIG. 1.
Figure 3:
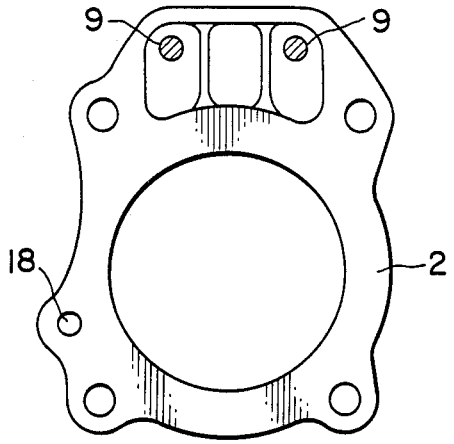
FIG. 3 is a partial side sectional view taken along the line III—III of FIG. 1.

Referring next to FIG. 2, reference numeral 19 represents a flywheel which also functions as a cooling fan and is connected to the crankshaft (not shown). The flywheel 19 is covered with a blower housing 20.

Next, the mode of operation of the first preferred embodiment having the above-described construction will be described. When the engine is started, the oil pump 17 which is connected to the crankshaft (not shown) sucks the lubricating oil stored in the oil pan 1d, and the lubricating oil discharged from the oil pump 17 is forced to flow through the oil element 16 and the lubricating oil passage 1c to the main bearings (not shown) supporting the crankshaft (not shown) and the large-diameter end of the connecting rod and into the lubricating oil passage 11c extended in the suction pipe 11.

The lubricating oil which flows into the lubricating oil passage 11c flows in the opposite directions in the lubricating oil passage 11c and is injected through the nozzle 3d formed in the cylinder head 3 into the rocker chamber 5, thereby lubricating the rocker arm 6, the push rod 9, the valve 10 and other component parts of the valve operating mechanism.

When the pressure in the crank chamber 1a becomes positive, the blow-by gas filling the crank chamber 1a flows into the first breather chamber 14b of the breather 14 and passes through the breather valve 14a so that the lubricating oil mist contained in the blow-by gas is separated and only the blow-by gas flows into the second breather chamber 14c.

The blow-by gas which flows into the second breather chamber 14c further flows through the breathing passage 14d into the pressure passage 11b. Then a portion of the blow-by gas flows through the nipple 11e and the breathing pipe 15 into the air cleaner 13 to be burned again. The remaining blow-by gas flows through the pressure passage 11b and the pressure passage 3b extended in the cylinder head 3 into the rocker chamber 5, whereby the pressure in the rocker chamber 5 rises.

Then, the lubricating oil which remains in the rocker chamber 5, is forced to flow through the oil return passage 18, the outlet port 18a of which, is opened into the lubricating oil stored in the oil pan 1d so that the lubricating oil is returned to the oil pan 1d.

That is, the output port 18a of the oil return passage 18 is immersed and opened into the lubricating oil so that no blow-back from the oil return passage 18 occurs, and so that the lubricating oil can be forced to be discharged due to the pressure difference. As a result, the lubricating oil is prevented from filling the rocker chamber 5 and the efficient circulation of the lubricating oil can be ensured.

Furthermore, when the lubricating oil is flowing through the lubricating oil passage 11c extended in the suction pipe 11, the heat of the lubricating oil preheats the combustion mixture flowing through the suction passage 11a extended immediately above the lubricating oil passage 11c, so that the atomization of the combustion mixture flowing along the wall of the suction passage 11a and the vaporization of the combustion mixture are enhanced. Furthermore, the carburetor 12 is also preheated due to heat conduction from the lubricating oil, therefore avoiding the problem of icing of the carburetor 12.

Figure 4:
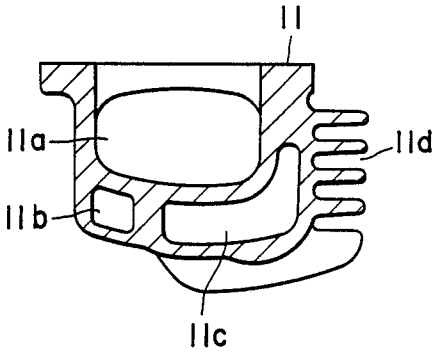
FIG. 4 is a partial sectional view, on an enlarged scale, of a portion IV surrounded by a circle in FIG. 2.
Figure 5:
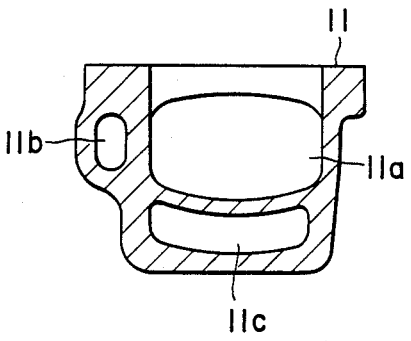
FIG. 5 is a view similar to FIG. 4 but illustrating another embodiment of the present invention.

FIG. 5 shows another preferred embodiment of the present invention, and corresponds to FIG. 4 of the first embodiment. In the second embodiment, the lubricating oil passage 11c is extended below the bottom of the suction passage 11a across the whole width thereof so that the atomization of the combustion mixture flowing along the wall of the suction passage 11a and the vaporization of the combustion mixture can also be enchanced.

It is to be understood that the present invention is not limited to the above-described embodiments and that it may be equally applied to various types of internal combustion engines such as air-cooled horizontal opposed-piston engines, water-cooled in-line engines, V-type engines and so on.

What is claimed is:

1. A lubrication system for an engine, comprising:

a crank chamber for housing a crank shaft and storing lubricating oil;

a rocker chamber for housing a rocker arm;

a breather device, interposed between said crank chamber and said rocker chamber, for breathing air;

oil supply means for supplying said lubricating oil from said crank chamber to said rocker chamber;

air induction means including an air induction passage for inducing an air fuel mixture into a combustion chamber of said engine, a lubricating oil passage, connected between said crank chamber and said rocker chamber for lubricating said rocker arm with said lubricating oil and for preheating said air fuel mixture, and a pressure passage connected between said breather device and said rocker chamber, for spraying said oil provided to said rocker chamber through said oil passage.

2. A lubrication system according to claim 1, further comprising:

lubricating oil return means for returning said lubricating oil in said rocker chamber to said crank chamber.

3. A lubrication system according to claim 2, wherein said lubricating oil return means comprises a lubricating oil return passage having an inlet in the vicinity of the bottom of said rocker chamber and an outlet below the level of said lubricating oil in said crank chamber.

4. A lubrication system according to claim 1, wherein said lubricating oil passage has a nozzle opening into said rocker chamber.

5. A lubrication system according to claim 1, wherein said air induction means is positioned on the upper portion of said engine.

6. A lubrication system according to claim 1, wherein said lubricating oil passage extends along side said air induction passage.

7. A lubrication system according to claim 1, wherein said pressure passage extends along side said air induction passage.

* * * * *